US009677453B2

(12) United States Patent
Wegener et al.

(10) Patent No.: US 9,677,453 B2
(45) Date of Patent: Jun. 13, 2017

(54) EXHAUST MANIFOLD FOR AN EXHAUST SYSTEM OF A COMBUSTION ENGINE

(71) Applicant: Benteler Automobiltechnik GmbH, Paderborn (DE)

(72) Inventors: Mario Wegener, Borgentreich (DE); Elmar Grussmann, Altenbeke-Buke (DE); Uwe Fischer, Bad Arolsen (DE); Tobias Gockel, Meschede (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 14/657,547

(22) Filed: Mar. 13, 2015

(65) Prior Publication Data

US 2015/0267599 A1 Sep. 24, 2015

(30) Foreign Application Priority Data

Mar. 20, 2014 (DE) ..... 10 2014 103 809

(51) Int. Cl.
*F01N 3/00* (2006.01)
*F01N 3/02* (2006.01)
(Continued)

(52) U.S. Cl.
CPC ..... *F01N 13/1811* (2013.01); *F01N 13/102* (2013.01); *F01N 13/105* (2013.01);
(Continued)

(58) Field of Classification Search
CPC .... F01N 13/102; F01N 13/105; F01N 13/107; F01N 13/141; F01N 13/1811; F01N 13/1844; F01N 13/1888
(Continued)

(56) References Cited

U.S. PATENT DOCUMENTS 5,729,975 A 3/1998 Bekkering
5,916,137 A 6/1999 Hayashi
(Continued)

FOREIGN PATENT DOCUMENTS

CN 101469631 A 7/2009
CN 101688463 A 3/2010
(Continued)

OTHER PUBLICATIONS

Chinese Search Report issued on Dec. 22, 2016 by the Chinese Patent Office in Chinese Patent Application No. 2015103085491.
(Continued)

*Primary Examiner* — Mark A Laurenzi
*Assistant Examiner* — Dapinder Singh
(74) *Attorney, Agent, or Firm* — Henry M. Feiereisen LLC

(57) ABSTRACT

An exhaust manifold for an exhaust system of a combustion engine includes an outer shell, an inner shell arranged in the outlet shell, and an inlet flange which is configured for attachment to a cylinder head of the combustion engine and has a receptacle. The inner shell is floatingly supported in the outer shell and has an inlet-flange-side edge which is formed with an outwardly bent flange positioned in the receptacle of the inlet flange. The outer shell has an inlet-flange-side edge which has at least one area which rests in the receptacle upon the outwardly bent flange and is joined with the receptacle.

13 Claims, 5 Drawing Sheets

(51) Int. Cl.

| | |
|---|---|
| ***F01N 3/10*** | (2006.01) |
| ***F01N 3/20*** | (2006.01) |
| ***F01N 13/10*** | (2010.01) |
| ***F01N 13/18*** | (2010.01) |
| ***F01N 13/14*** | (2010.01) |

(52) U.S. Cl.
CPC ..... *F01N 13/107* (2013.01); *F01N 13/141* (2013.01); *F01N 13/1844* (2013.01); *F01N 13/1888* (2013.01)

(58) Field of Classification Search
USPC ..... 60/323, 324
See application file for complete search history.

(56) References Cited

U.S. PATENT DOCUMENTS

| | | | | |
|---|---|---|---|---|
| 6,789,386 | B1 | 9/2004 | Haerle | |
| 8,356,411 | B2 * | 1/2013 | Hill, Jr. ..... | B21D 53/84 29/890.08 |
| 2005/0133012 | A1 | 6/2005 | Grussmann et al. | |
| 2010/0098533 | A1 | 4/2010 | Grussmann et al. | |
| 2010/0223911 | A1 | 9/2010 | Gockel et al. | |
| 2011/0131985 | A1 | 6/2011 | Smatloch et al. | |
| 2011/0236191 | A1 | 9/2011 | Grussmann et al. | |
| 2011/0286837 | A1 | 11/2011 | Smatloch et al. | |
| 2011/0308238 | A1 | 12/2011 | Grussmann et al. | |
| 2012/0023928 | A1 | 2/2012 | Smatloch et al. | |
| 2012/0102737 | A1 | 5/2012 | Smatloch et al. | |
| 2012/0104224 | A1 | 5/2012 | Ewers et al. | |
| 2012/0294709 | A1 | 11/2012 | Grussmann et al. | |
| 2013/0064655 | A1 | 3/2013 | Smatloch et al. | |
| 2013/0064656 | A1 | 3/2013 | Smatloch et al. | |

FOREIGN PATENT DOCUMENTS

| | | |
|---|---|---|
| DE | 101 02 637 | 7/2002 |
| DE | 102 23 838 | 10/2003 |
| EP | 0 671 551 | 9/1995 |
| EP | 1 365 121 | 11/2003 |
| EP | 1 206 631 | 2/2005 |
| EP | 2 207 950 | 5/2011 |

OTHER PUBLICATIONS

English translation of Chinese Search Report issued on Dec. 22, 2016 by the Chinese Patent Office in Chinese Patent Application No. 2015103085491.

* cited by examiner

EXHAUST MANIFOLD FOR AN EXHAUST SYSTEM OF A COMBUSTION ENGINE

CROSS-REFERENCES TO RELATED APPLICATIONS

This application claims the priority of German Patent Application, Serial No. 10 2014 103 809.6, filed Mar. 20, 2014, pursuant to 35 U.S.C. 119(a)-(d), the disclosure of which is incorporated herein by reference in its entirety as if fully set forth herein.

BACKGROUND OF THE INVENTION

The present invention relates to an exhaust manifold for an exhaust system of a combustion engine.

The following discussion of related art is provided to assist the reader in understanding the advantages of the invention, and is not to be construed as an admission that this related art is prior art to this invention.

An exhaust manifold is a component of the exhaust system of a combustion engine and has an inner system and an outer shell which surrounds the inner system. The exhaust manifold is intended for attachment to the cylinder head of the combustion engine. For this purpose, the exhaust manifold is flange-mounted directly onto the cylinder head of the combustion engine so as to collect exhaust gas, which exits the individual cylinders via an exhaust outlet. Thus, an exhaust manifold is oftentimes also referred to as exhaust collector.

Heretofore, the automobile industry is faced with the problem to reconcile a demand for compactness and simplicity of exhaust manifolds while still meeting the challenges to cope with the substantial temperature stress to which components of an exhaust manifold are exposed. Thus, the service life of conventional exhaust manifolds is inadequate to date.

It would therefore be desirable and advantageous to provide an improved exhaust manifold to obviate prior art shortcomings.

SUMMARY OF THE INVENTION

According to one aspect of the present invention, an exhaust manifold for an exhaust system of a combustion engine includes an inlet flange configured for attachment to a cylinder head of the combustion engine and having a receptacle, an outer shell having an inlet-flange-side edge, and at least one inner shell floatingly supported in the outer shell and having an inlet-flange-side edge formed with an outwardly bent flange which is positioned in the receptacle of the inlet flange, wherein the inlet-flange-side edge of the outer shell has at least one area which rests in the receptacle upon the outwardly bent flange and is joined with the receptacle.

The inner shell or, as it is currently preferred two inner shells, form(s) part of an inner system and are/is positioned in place via their outwardly bent flange in the receptacle of the inlet flange. In this way, the inner system is floatingly supported in the exhaust manifold. The inner system is fixed in place by the outer shell which has an edge on the side facing the inlet flange to also engage the receptacle and rests with end faces of the edge upon the outwardly bent flange of the inner shell. The outer shell is joined with the receptacle, e.g. via a circumferential weld. This ensures gas tightness of the exhaust manifold. As a result of the floating support of the inner system or inner shell(s), thermal expansions of the system can be compensated.

The outer shell forms an outer system of the exhaust manifold. Advantageously, the outer shell is comprised of at least two shell members, such as an upper shell and a lower shell. The inner system of the exhaust manifold includes in addition to the inner shell or inner shells one or two outlet-side pipe sections to connect the inner shell(s) to an outlet flange.

An exhaust manifold according to the invention thus is simple in structure, compact, and can be installed in an efficient manner. The interaction of inner shell, outer shell, and inlet flange and their securement in relation to one another reduces thermal expansions and disadvantageous temperature impacts. In particular, the presence of detrimental temperatures on the outer shell, which forms the load-carrying and gastight shell of the system, is prevented so that the service life of the exhaust manifold is overall prolonged. Tightness of the system is ensured in a reliable and simple way, without the need for complex seals. Moreover, an exhaust manifold according to the present invention can be built overall of reduced weight and thin-walled so that the thermal mass and thus the response behavior of a downstream catalytic converter can be improved after a cold start.

According to another advantageous feature of the present invention, the receptacle of the inlet flange can have a pocket-shaped configuration and can have a circumferential collar sized to project in a direction of the outer shell. The collar has a web or neck-like configuration and extends all-round along the receptacle. The collar has a contour which is suited to an outer contour of the outer shell. The outer shell can be welded with the collar. Advantageously, the collar has a wall thickness which substantially corresponds to a wall thickness of the outer shell. Currently preferred is a deviation between the wall thickness of the outer shell and the wall thickness of the collar of not more than 15%. As the wall thicknesses of collar and outer shell are substantially the same, welding to join these two components is made easier and improved.

According to another advantageous feature of the present invention, the inner shell in the receptacle can have at least one area which is joined to the outer shell. Advantageously, the inner shell in the receptacle is spot-joined to the outer shell. This enhances stability of the inner shell and resists dynamic loads, such as vibrations in the system.

According to another advantageous feature of the present invention, fiber material can be placed between the inner shell and the outer shell. The fiber material has insulating and elastic properties. Examples of suitable fiber material include a single-part or multipart fiber mat. The fiber material secures the inner shell in the outer shell and clamps it in place, so that the inner shell is properly aligned within the outer shell. The clamping force upon the inner system may be varied by the mat thickness in the presence of a given air gap. Furthermore, the temperature of the outer system can be varied by the fiber material or mat thickness, fiber material density, and type of the fiber material. The fiber material also serves as damping element. The fiber material between the inner shell and the outer shell provides support for these components relative to one another. The need for additional support elements or positioning aids, such as, for example, wire meshes, can be eliminated. The fiber material also reduces thermal stress on the outer shell. This also promotes longer service life of the exhaust manifold.

The inner system, which may include one or more inner shells, may be configured as modular concept. The inner system can hereby be suited to flow requirements in a simple manner. It is furthermore possible to structurally integrate an exhaust pipe geometry into the inlet flange, especially through respective configurations of inlet openings in the inlet flange. The inner shell or inner shells can be floatingly supported in the outer flange by the fiber material and maintained in place. Currently preferred is the use of a prefabricated and preformed single part or multipart fiber mat. The fiber material is used as damping element and clamps the inner system of the exhaust manifold. The connection of the outer system, i.e. the outer shell with the inlet flange, is realized by welding. The need for additional seals or tensioning elements between inlet flange and outer system can be eliminated, thereby enhancing robustness and saving costs. Leakage between inner system and outer system is minimized in an exhaust manifold according to the present invention so that inadvertent overflow of exhaust gases is reduced or avoided altogether.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
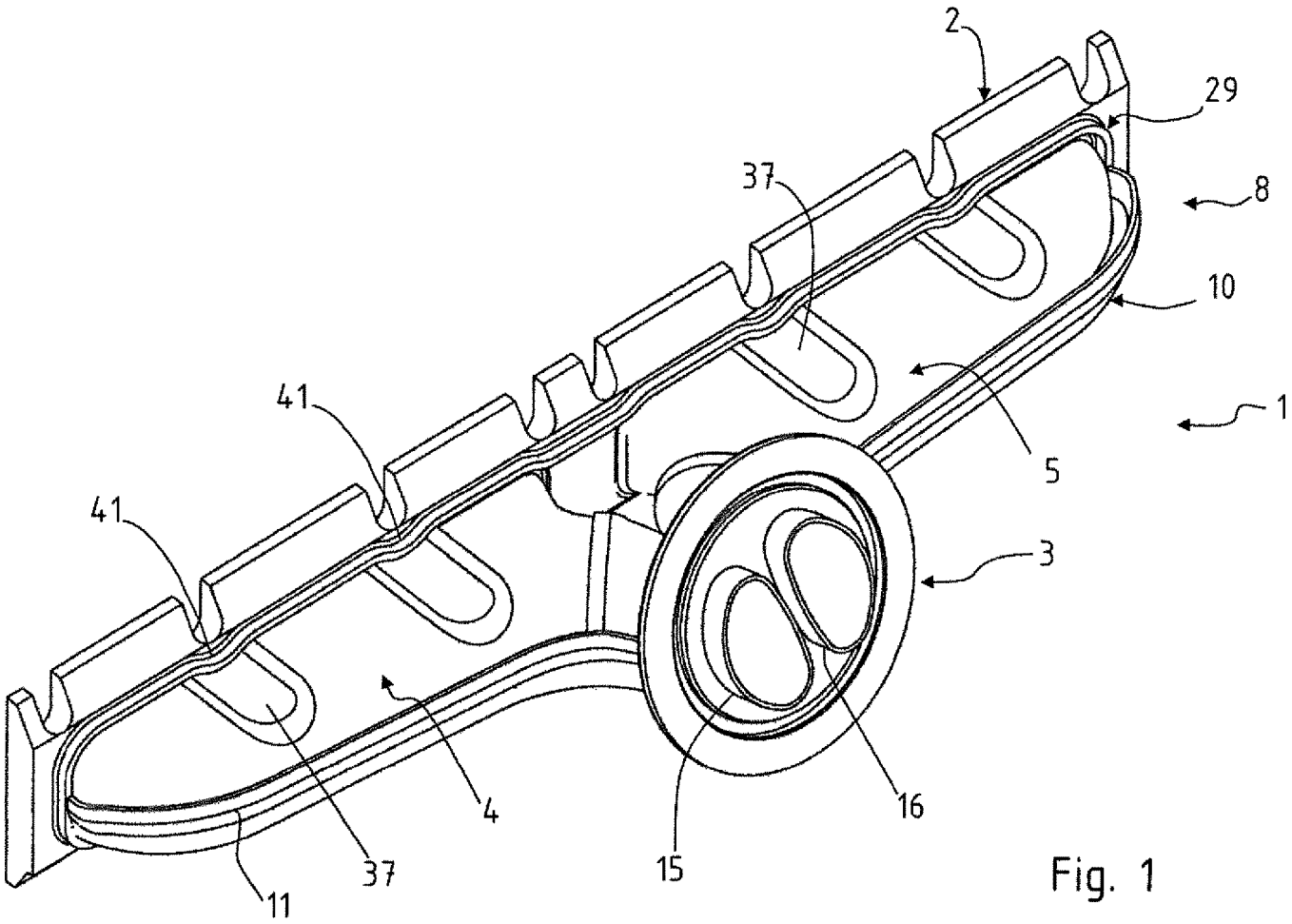
FIG. 1 is a perspective view of an exhaust manifold according to the present invention, depicting a partly open outer shell and view of an inner system.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective view of an exhaust manifold according to the present invention, generally designated by reference numeral 1 for an exhaust system of a combustion engine. The exhaust manifold 1 includes an inlet flange 2, an outlet flange 3, an inner system comprised of two inner shells 4, 5 and two outlet-side pipe sections 6, 7, and an outer system in spaced-apart surrounding relation to the inner system. The outer system includes an outer shell 8 which is comprised of two shell members 9, 10 defining a bottom shell and a top shell. The shell members 9, 10 have overlapping edges 11, 12 which are connected to one another, in particular welded to one another.

The inlet flange 2 is configured for clamped attachment onto a cylinder head of the combustion engine and has inlet openings 13, 14 (FIG. 4) which communicate with outlet openings of the cylinder bank. Exhaust gas from the individual cylinders of the combustion engine flows via the inlet openings 13, 14 into the inner shells 4, 5 which collect and deflect the exhaust gas which is fed via the terminal pipe sections 6, 7 to the outlet flange 3. The inner shells 4, 5 of the inner system are of same geometry and arranged in symmetry to the vertical center axis. The terminal pipe sections 6, 7 respectively connect the inner shells 4, 5 with the outlet flange 3.

Figure 4:
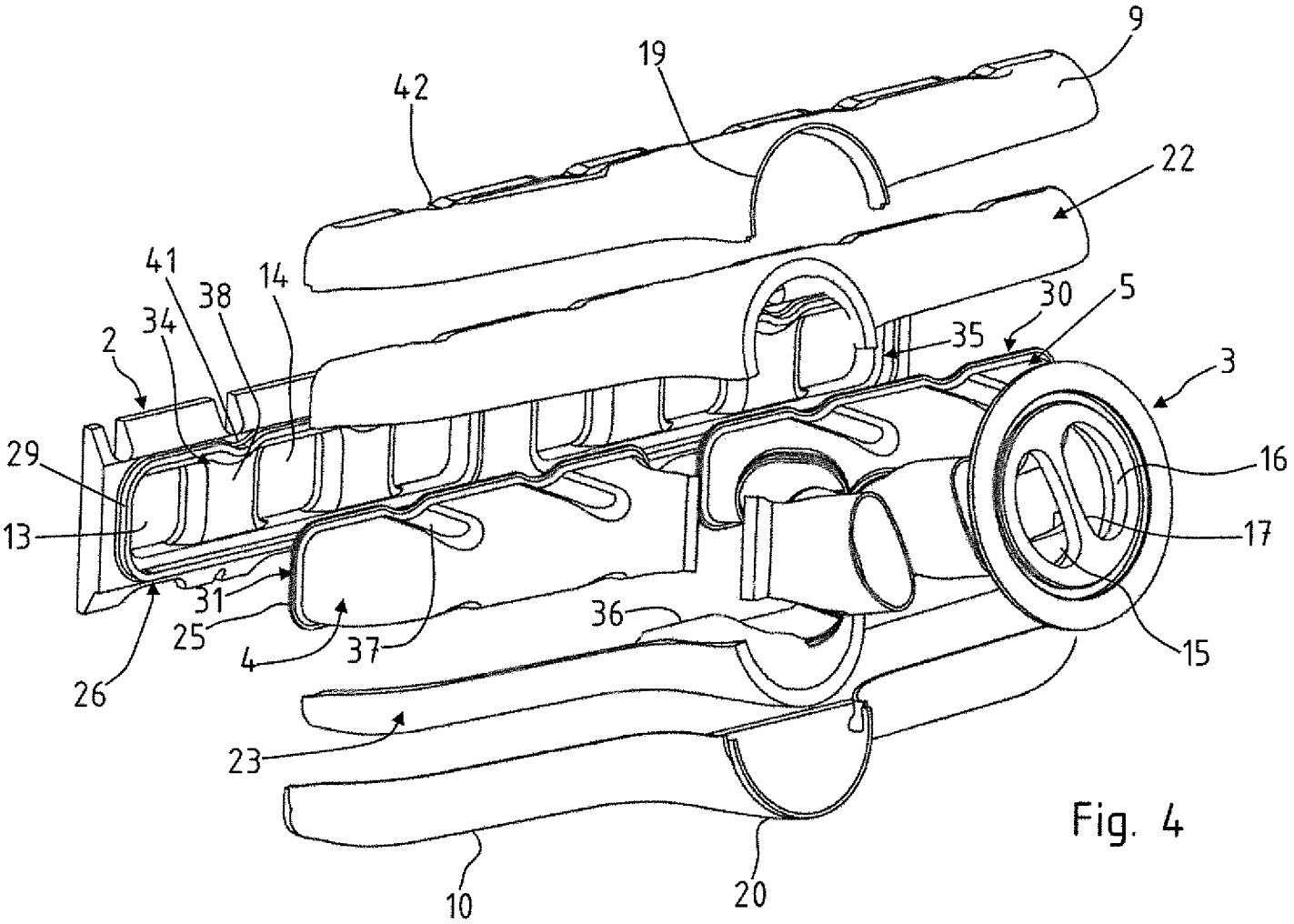
FIG. 4 is a perspective exploded view of the exhaust manifold, showing components of the exhaust manifold from the front.
Figure 5:
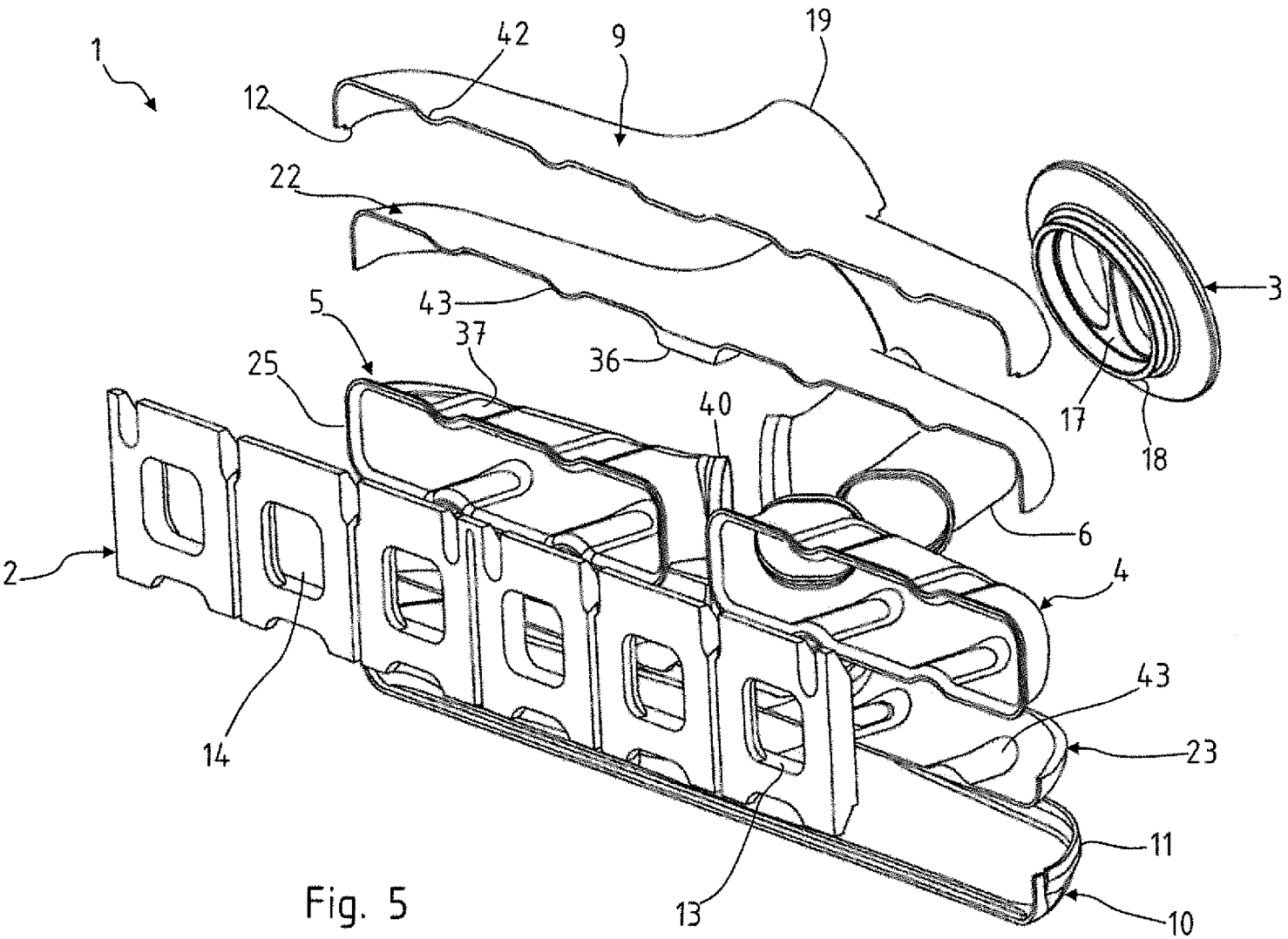
FIG. 5 is a perspective exploded view of the exhaust manifold, showing components of the exhaust manifold from the back.

The outlet flange 3 has two semicircular receiving openings 15, 16 which are separated by a central bridge 17 (FIG. 5). The pipe sections 6, 7 end in the receiving openings 15, 16 and are configured on the side of the outlet flange 3 such as to fit form fittingly in the receiving openings 15, 16. The outlet flange 3 is joined to the outer shell 8 by a material joint, in particular by welding. For this purpose, the outlet flange 3 has a side which faces the outer shell 8 and is provided with a ring-shaped neck 18. The neck 18 is embraced about its outer circumference by complementing rounded end portions 19, 20 (FIG. 4) of the shell members 9, 10 and sealingly joined thereto.

The exhaust manifold 1 is coupled via the outlet flange 3 to downstream exhaust components, in particular an exhaust pipe or a turbocharger.

Figure 3:
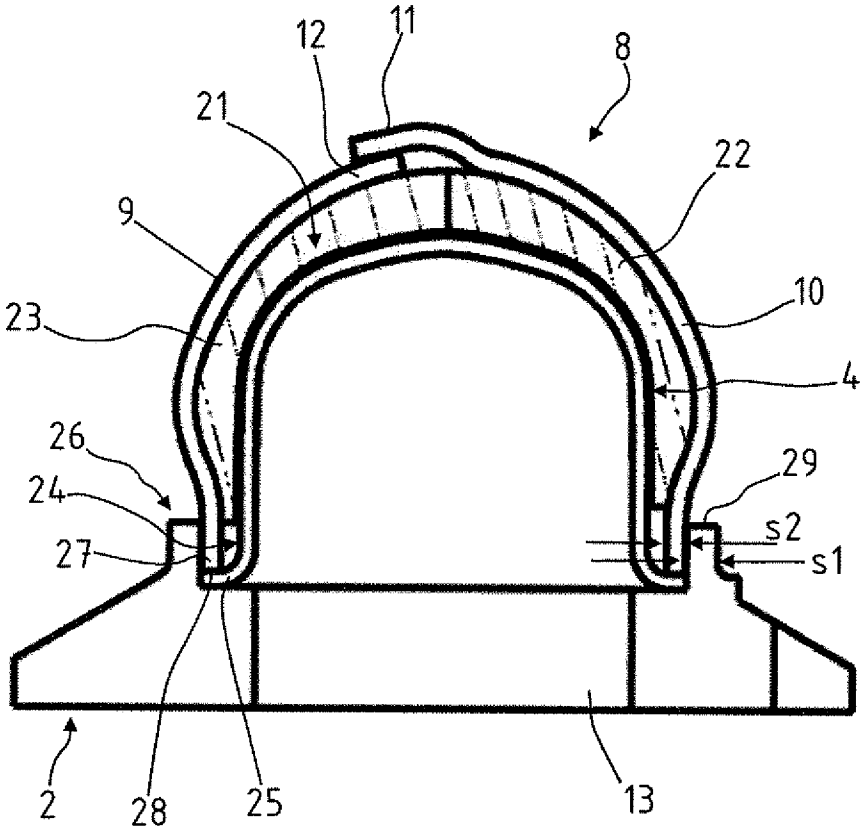
FIG. 3 is a cross section of the exhaust manifold.

As shown in particular in FIG. 3, a fiber material 21 is incorporated between the outer shell 8 and the inner shells 4, 5. The fiber material 21 is comprised of two shell bodies 22, 23 which are made of a fiber mat and define a lower shell body 22 and an upper shell body 23. The lower and upper shell bodies 22, 23 have an outer side, which is configured to complement an inner contour of the shell members 9, 10 of the outer shell 8, and an inner side, which is configured to complement an outer contour of the inner shells 4, 5. The fiber material 21 with its shell bodies 22, 23 aligns the inner shells 4, 5 in the outer shell 8 in relation to the inlet flange 2 and clamps the inner shells 4, 5 in place. As a result, the inner shells 4, 5 are positioned in the outer shell 8. Moreover, the fiber material provides thermal insulation of the outer shell 8 against the inner shells 4, 5.

Figure 2:
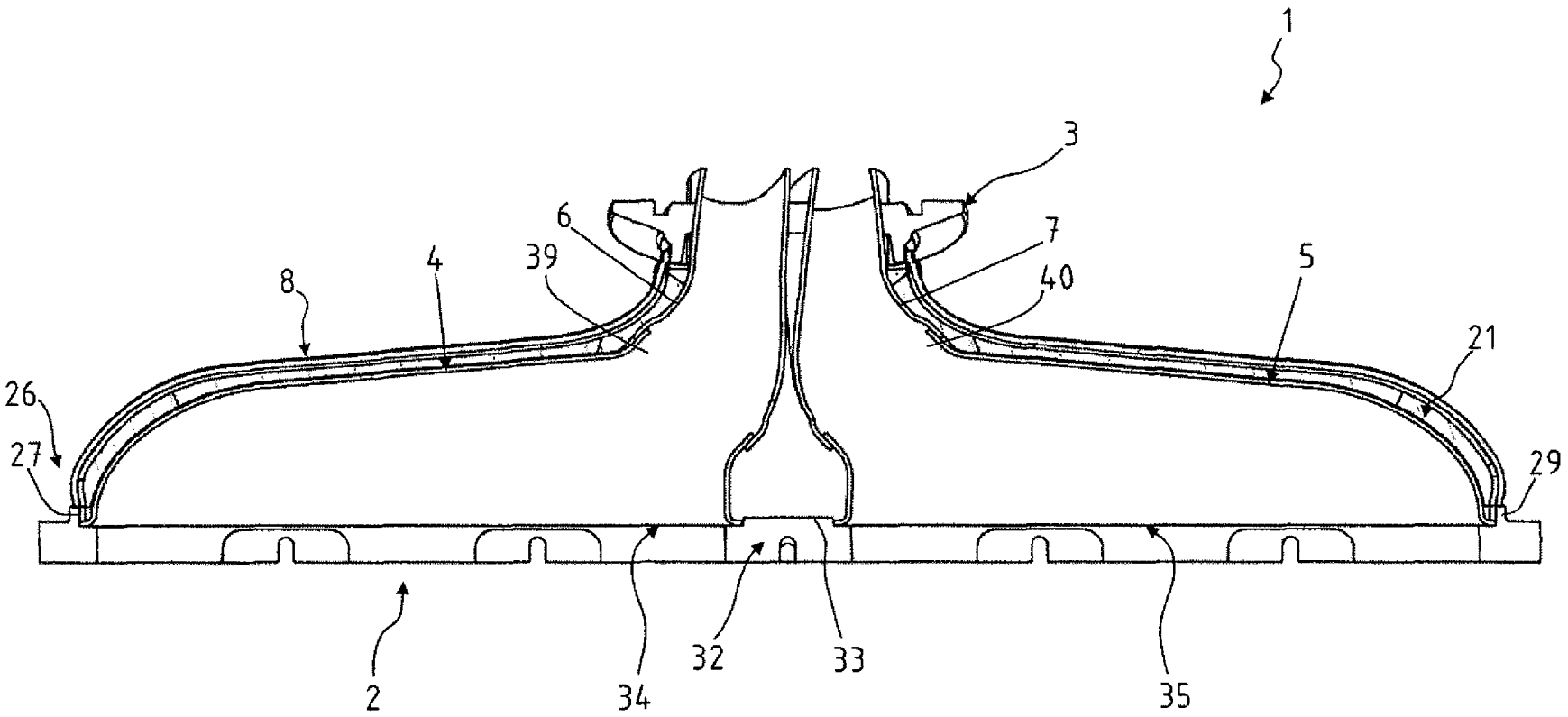
FIG. 2 is a longitudinal section of the exhaust manifold of FIG. 1.

The inner shells 4, 5 involve sheet metal parts and have on the inlet side an inlet-flange-side edge 24 formed with an outwardly bent flange 25. The inlet flange 2 has a receptacle 26 (FIGS. 2, 3). The inner shells 4, 5 are inserted and positioned with the flange 25 in the receptacle 26. The outer shell 8 spans the inner shells 4, 5 and has an inlet-flange-side edge 27 which engages in the receptacle 26. The outer shell 8 rests hereby with its end face 28 of the edge 27 over part of the perimeter of the inner shells 4, 5 obtusely upon the flanges 25 of the inner shells 4, 5. The receptacle 26 has a circumferential collar 29 which projects in a direction toward the outer shell 8 and the inner shells 4, 5. The collar 29 is configured to conform to a contour of the edge 27 of the outer shell 8 and a contour of longitudinal sides 30 and outer short sides 31 of the inner shells 4, 5. The outer shell 8 is joined to the receptacle 26. For this purpose, the outer shell 8 is welded to the collar 29. A center bridge 33 (FIG. 2) is formed between the inner shells 4, 5 in midsection 32 of the inlet flange 2. The center bridge 33 splits the receptacle 26 into a receiving pocket 34 for the inner shell 4 and a receiving pocket 35 for the inner shell 5.

The inner shells 4, 5 are floatingly supported in the outer shell 8 by the fiber material 21 or shell bodies 22, 23 and maintained in position in an elastically supported manner. In midsection 32, the shell bodies 22, 23 of fiber material 21 have each a protrusion 36. The protrusions 36 of the lower shell body 22 and the upper shell body 23 point toward each other and project between the inner shell 4 and the inner shell 5. As a result, the shell bodies 22, 33 and the outer shell 8 assist in a positioning of the inner shells 4, 5.

The connection of the outer shell 8 with the inlet flange 2 is realized, as described above, by a material joint using a thermal joining process, in particular welding. For this purpose, the outer shell 8 is welded to the collar 29. Advantageously, the collar 29 has a wall thickness s1 which substantially corresponds to a wall thickness s2 of the outer shell 8 (FIG. 2).

The inner shells 4, 5 have depressions 37 (FIGS. 1, 4) which extend from the inlet openings 13, 14 in the inlet flange 2 in flow direction of exhaust gas. The depressions 37 are respectively formed in a region of a central portion 38 of the inlet flange 2 between two inlet openings 13, 14, as best seen in FIG. 4. The depressions 37 assist the flow of exhaust gas through the inner shells 4, 5 from the inlet openings 13, 14 in the inlet flange 2 to the outlet flange 3. Outlet openings 39, 40 of the inner shells 4, 5 transition into pipe sections 6 and 7, respectively, which have ends to span the outlet openings 39, 40, as shown in FIG. 2.

The receptacle 26 and the collar 29 as well as the outer shell 8 and the shell bodies 22, 23 have a contour to conform to the depressions 37 in the inner shells 4, 5. In the areas of the central portions 38, the receptacle 26 and the collar 29 are formed with rounded sections 41 of a contour which complements a contour of the depressions 37. The outer shell 8 is also provided with depressions 42 of a contour to match a contour of the depressions 37 and rounded sections 41. The lower shell body 22 and the upper shell body 23 have inwardly directed bulges 43 of a contour that complements the depressions 37, 42.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An exhaust manifold for an exhaust system of a combustion engine, comprising:

an inlet flange configured for attachment to a cylinder head of the combustion engine, said inlet flange having a receptacle;

an outer shell having an inlet-flange-side edge; and at least two shells forming an inner unitary shell system floatingly supported in the outer shell and having an inlet-flange-side edge formed with an outwardly bent flange which is positioned in the receptacle of the inlet flange, wherein the inlet-flange-side edge of the outer shell has at least one area which rests in the receptacle upon the outwardly bent flange in a perpendicular arrangement and is joined with the receptacle.

2. The exhaust manifold of claim 1, wherein the receptacle of the inlet flange has a pocket-shaped configuration.

3. The exhaust manifold of claim 1, wherein the receptacle has a circumferential collar sized to project in a direction of the outer shell.

4. The exhaust manifold of claim 1, further comprising a fiber material placed between the inner shell and the outer shell.

5. The exhaust manifold of claim 4, wherein the inner shell is aligned by the fiber material within the outer shell.

6. The exhaust manifold of claim 1, wherein the outer shell is welded to the receptacle.

7. The exhaust manifold of claim 3, wherein the outer shell is welded to the collar.

8. The exhaust manifold of claim 3, wherein the collar has a wall thickness which substantially corresponds to a wall thickness of the outer shell.

9. The exhaust manifold of claim 3, wherein the collar has a wall thickness which deviates from a wall thickness of the outer shell by not more than 15%.

10. The exhaust manifold of claim 1, wherein the inner shell in the receptacle has at least one area which is joined to the outer shell.

11. The exhaust manifold of claim 1, wherein the inner shell in the receptacle has at least one area which is spot-joined to the outer shell.

12. The exhaust manifold of claim 1, wherein the outer shell is comprised of at least two shell members.

13. The exhaust manifold of claim 1, further comprising an outlet flange receiving exhaust gas from the inlet flange for discharge, said inner shell being a component of an inner system having a pipe section for connecting the inner shell with the outlet flange.

* * * * *